US009381656B2

(12) United States Patent
Van Straaten et al.

(10) Patent No.: US 9,381,656 B2
(45) Date of Patent: Jul. 5, 2016

(54) SKIN GUARD FOR HAIR TRIMMER

(71) Applicant: KONINKLIJKE PHILIPS N.V., Eindhoven (NL)

(72) Inventors: Roland Van Straaten, Groningen (NL); Roel Alexander Rethmeier, Drachten (NL); Reinier Alexander Tijsseh, Zwolle (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 101 days.

(21) Appl. No.: 14/358,781

(22) PCT Filed: Nov. 13, 2012

(86) PCT No.: PCT/IB2012/056375

§ 371 (c)(1),
(2) Date: May 16, 2014

(87) PCT Pub. No.: WO2013/072840

PCT Pub. Date: May 23, 2013

(65) Prior Publication Data

US 2014/0317932 A1 Oct. 30, 2014

Related U.S. Application Data

(60) Provisional application No. 61/560,933, filed on Nov. 17, 2011.

(51) Int. Cl.

| | |
|---|---|
| ***B26B 19/38*** | (2006.01) |
| ***B26B 19/06*** | (2006.01) |
| ***B26B 19/20*** | (2006.01) |

(52) U.S. Cl.
CPC ..... *B26B 19/38* (2013.01); *B26B 19/06* (2013.01); *B26B 19/20* (2013.01)

(58) Field of Classification Search
CPC ..... B26B 19/06; B26B 19/20; B26B 19/38
See application file for complete search history.

(56) References Cited

U.S. PATENT DOCUMENTS

| | | | | |
|---|---|---|---|---|
| 2,152,815 | A * | 4/1939 | Muros | B26B 19/06 30/225 |
| 2,170,215 | A * | 8/1939 | Rand, Jr. | B26B 19/42 30/34.2 |
| 2,194,465 | A | 3/1940 | Bott | |

(Continued)

FOREIGN PATENT DOCUMENTS

| | | | |
|---|---|---|---|
| DE | 102007050379 | A1 | 4/2009 |
| EP | 2 465 652 | A1 * | 6/2012 |

(Continued)

*Primary Examiner* — Hwei C Payer

(57) ABSTRACT

A device for trimming hair includes a fixed cutting element, a mobile cutting element and a fixed guard, each including a plurality of teeth that extends in a similar direction. The mobile cutting element is moveable relative to the fixed cutting element such that hairs are cut when they enter a space between the teeth. The mobile cutting element is positioned between the fixed cutting element and the fixed guard, and when in use, the fixed guard is the component closest to the skin to be shaved in a certain direction. A length of the teeth of the fixed and mobile cutting elements and the fixed guard differ so that, during use, the fixed cutting element and the fixed guard may contact the skin but the mobile cutting element is restricted from fully contacting the skin to prevent damage or irritation of the skin.

20 Claims, 3 Drawing Sheets

(56) References Cited

U.S. PATENT DOCUMENTS

| | | | | |
|---|---|---|---|---|
| 2,216,797 | A | 10/1940 | Andis | |
| 2,867,902 | A | 1/1959 | Groves | |
| 4,512,077 | A * | 4/1985 | Tanabe | B26B 19/06 30/41 |
| 4,724,614 | A | 2/1988 | Wahl et al. | |
| 8,028,422 | B2 * | 10/2011 | Mikula | B26B 19/20 30/216 |
| 8,136,250 | B2 * | 3/2012 | Floessholzer | B26B 19/06 30/346.51 |
| 2009/0133266 | A1 * | 5/2009 | Eichhorn | B26B 19/048 30/43.7 |
| 2010/0299928 | A1 | 12/2010 | Clarke et al. | |
| 2011/0016723 | A1 | 1/2011 | Maichel et al. | |
| 2011/0016729 | A1 | 1/2011 | Geiser et al. | |
| 2014/0317932 | A1 * | 10/2014 | Van Straaten | B26B 19/06 30/34.1 |

FOREIGN PATENT DOCUMENTS

| | | | |
|---|---|---|---|
| GB | 0624077 | A | 10/1940 |
| WO | 2009024900 | A1 | 2/2009 |

* cited by examiner

SKIN GUARD FOR HAIR TRIMMER

CROSS-REFERENCE TO PRIOR APPLICATIONS

This application is the U.S. National Phase application under 35 U.S.C. §371 of International Application No. PCT/IB2012/056375, filed on Nov. 13, 2012, which claims the benefit of U.S. Provisional Patent Application No. 61/560,933, filed on Nov. 17, 2011. These applications are hereby incorporated by reference herein.

FIELD OF THE INVENTION

This invention relates to a hair trimmer, more specifically to a guard to protect the skin from damage or irritation during use of the hair trimmer. The invention also relates to a shaver incorporating the hair trimmer according to the invention.

BACKGROUND OF THE INVENTION

Electric shaving devices are used for removing hair from different parts of the body. A typical shaver type is a trimmer-foil-trimmer assembly, as shown in FIG. 1, comprising pre-trimming trimmers, for trimming longer hairs, positioned either side of a shaving foil, for cutting short hairs, so that the shaver can be moved in two directions and performs a two-stage cutting process of pre-trimming and then shaving hairs.

Typically, a pre-trimmer comprises stationary cutting teeth and moving cutting teeth that cooperate to trap and cut hairs that pass between the cutting teeth. Such an example of this arrangement can be seen in U.S. Pat. No. 4,724,614 which discloses a row of stationary cutting teeth adjacent to a row of moving cutting teeth. The stationary teeth protrude further than the moveable teeth and contact the skin of the user to prevent direct contact between the moveable cutting teeth and the skin which will cause irritation. The stationary teeth are positioned above the moveable teeth, with respect to the skin, so that hair is cut as short as possible. However, this arrangement does not entirely prevent the moveable cutting teeth from contacting the skin and causing irritation or damage. Furthermore, the stationary teeth may have sharp edges and may be small enough to catch on some features on the surface of the skin, so as the shaver is moved across the skin the stationary teeth may cause damage and irritation.

Therefore, it is desirable to provide a hair trimming device to substantially alleviate irritation of the skin due to the moveable or stationary cutting teeth.

It is known from WO 2009/024900 A1 to provide a hair trimming device comprising fixed cutting teeth, mobile cutting teeth and a stationary guard to protect the skin from the ends of the fixed teeth as the shaver is moved across the skin. The guard is positioned over a surface of the fixed teeth facing away from the skin and also extends over the ends of the fixed teeth to prevent the fixed teeth from digging into and damaging the skin as they are moved across the skin. The present invention seeks to further improve the performance of the hair trimming device of WO2009/024900 A1 by further reducing contact between the skin and the mobile cutting teeth.

It is known from U.S. 2011/0016723 A1 to provide a hair trimmer comprising protective teeth, fixed cutting teeth and mobile cutting teeth whereby the protective teeth are positioned between the skin and the fixed cutting teeth and the mobile cutting teeth are adjacent to the fixed cutting teeth on the side opposite to the skin. This arrangement results in good protection of the skin but means that the cutting plane (between the fixed and moveable cutting elements) is substantially removed from the surface of the skin and so the remaining hair length may be unsatisfactory.

The present invention seeks to alleviate or substantially reduce the problems described above.

SUMMARY OF THE INVENTION

According to the invention, there is provided, a hair trimming device comprising a mobile cutting element and a fixed cutting element on one side of the mobile cutting element. The fixed and mobile cutting elements each comprising a plurality of teeth, configured so that hairs entering the space between said teeth are cut when the mobile cutting element is moving relative to the fixed cutting element. A fixed guard is positioned on the opposite side of the mobile cutting element to the fixed cutting element to limit contact between the mobile cutting element and the skin.

When the device is in use the skin around the hair trimming device will deform and may come into contact with the mobile cutting element causing irritation to the user. The fixed guard is positioned to limit the contact between the skin and the mobile cutting element and so limit the irritation to the user.

The fixed guard provides a second contact point between the trimmer and the skin, resulting in contact between the device and the skin on either side of the mobile cutting element. This reduces the force between the fixed cutting element teeth and the skin, simply by spreading the load more. Reducing this force makes it less likely that the fixed teeth will irritate or damage the skin during use of the trimmer.

Preferably, the fixed guard comprises a plurality of teeth.

Preferably, the teeth of the fixed guard overlap with the teeth of the fixed element. The teeth of the fixed guard allow hairs to pass between them so that the effectiveness of the cutter is not reduced.

In one embodiment, a frame may support the fixed guard.

The fixed guard may be integrally formed with the frame, allowing the fixed guard to be rigidly positioned and reducing the number of components in the device.

Alternatively, the fixed guard may be removably attachable to the frame, giving the possibility of changing the fixed guard for different configurations, such as different tooth length or materials.

Alternatively, the fixed guard may be a separate component, attachable to the frame.

Preferably, the teeth of the fixed cutting element extend further from the supporting frame than the teeth of the fixed guard and/or the teeth of the mobile cutting element. The advantage of this is that the teeth of the fixed cutting element provide the main contact between the hair trimming device and the skin. The fixed cutting element thereby has two functions—providing cutting teeth and also maintaining spacing between the skin and the mobile cutting teeth.

Also, the teeth of the mobile cutting element may extend further from the supporting frame than the teeth of the fixed guard. This may be necessary to ensure that the effectiveness of the cutter is not limited by the fixed guard. The mobile cutting element must still be close to the skin to achieve an effective cut length but the fixed guard must prevent excessive contact between the skin and the mobile cutting element.

Preferably, the fixed cutting element and the fixed guard comprise an equal number of teeth.

Preferably, the teeth of the fixed cutting element and the teeth of the fixed guard are aligned. Cutting performance will be adversely effected if the teeth are not aligned because hairs will be prevented from entering the space between the cutting teeth where cutting takes place.

According to this embodiment the teeth of the mobile cutting element should be spaced differently to the teeth of the fixed guard and/or the fixed cutting element. This gives the advantage that not all of the cutting teeth are engaged in a cutting action at the same time, reducing the actuator power requirements to drive the mobile cutting element. It will also reduce the likeliness of jams or stalling of the actuator.

A further embodiment may include, a shaver, having a foil and a cutting blade associated with the foil to cut hair extending through the foil, and a hair trimming device, as described above, adjacent to said foil.

The shaver may include a hair trimming device adjacent to both sides of the foil so that the shaver can be moved in two directions while in use.

BRIEF DESCRIPTION OF THE DRAWINGS

Preferred embodiments will now be described, by way of example only, with reference to the accompanying drawings, in which.

DETAILED DESCRIPTION

Figure 1:
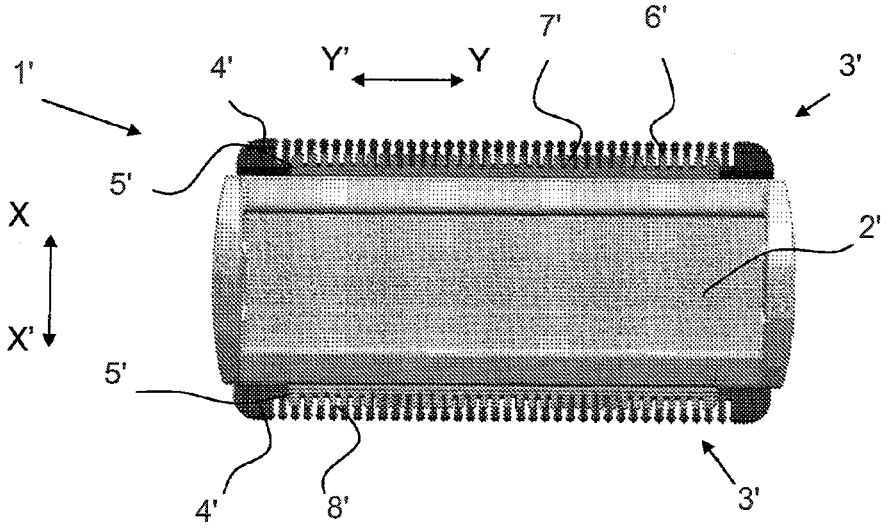
Figure 1 Prior Art
FIG. 1 shows an end view, from the skin contacting side of the shaver, of a hair shaver as is known in the art.

Referring to the drawings, FIG. 1 shows an end view of the hair shaver 1', as is known in the art, from the side of the shaver that would contact the skin. The shaver 1' comprises a foil shaver region 2', for cutting very short hairs, flanked by two pre-trimming regions 3' for trimming longer hairs prior to being shaved by the foil shaver 2'. When in use, the hair shaver is moved in direction X or X' over the skin.

The pre-trimming regions 3' are located on two opposite sides of the foil shaver region 2' and each comprise a fixed cutting element 4' and a mobile cutting element 5' that are positioned adjacent to each other and extend parallel to one another. The fixed cutting element 4' and the mobile cutting element 5' each comprise a plurality of cutting teeth 6', 7' and the mobile cutting element 5' is driven to reciprocate in the parallel direction Y and Y', so that as hairs enter the region 8' between the cutting teeth 6', 7' they are cut by the shearing action of the mobile cutting teeth 7' against the fixed cutting teeth 6'.

Figure 2:
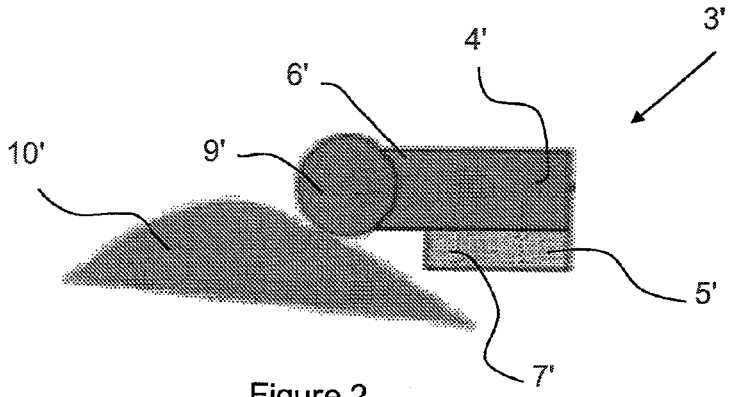
Figure 2 Prior Art
FIG. 2 shows a schematic side view of the shaver of FIG. 1, as is known in the art.

FIG. 2 shows a side view of the pre-trimming part 3' as is known in the art, showing the fixed cutting element 4 and the mobile cutting element 5'. Only one tooth 6', 7' of each cutting element 4, 5 is visible because the others are hidden behind tooth 6', 7'. It can be seen that the fixed cutting teeth 6' extend further than the mobile cutting teeth 7' and the distal ends 9' of the fixed cutting teeth 6' contact the skin 10' to maintain spacing between the skin 10' and the mobile cutting teeth 7'. This contact also causes deformation of the skin 10' as the shaver 1' is moved across the skin. The skin 10' domes up in front of the fixed cutting element 4' and this may cause the mobile cutting element 5' to come into contact with the skin 10'. The distal ends 9' of the fixed cutting teeth 6' are typically rounded to reduce irritation as the fixed cutting teeth 6' are moved over the skin. This feature is subject to a separate patent application by Philips.

Figure 3:
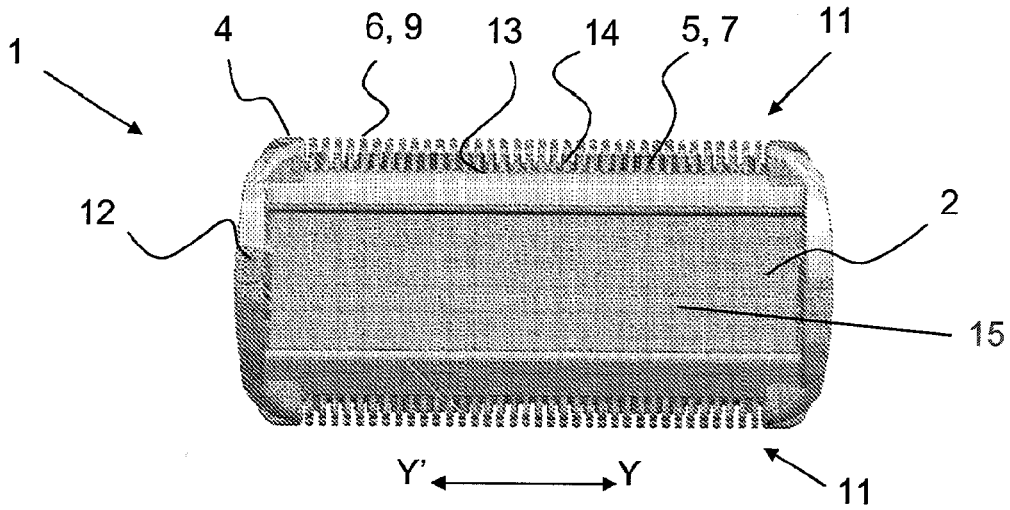
FIG. 3 shows an end view, from the skin contacting side of the shaver, of a first embodiment of the invention.

FIG. 3 shows an end view from the skin contacting side of a first embodiment of the invention comprising a foil shaving region 2 that has a pre-trimmer 11 on either side attached to a supporting frame 12. A cutting blade 15 may be associated with the foil shaving region 2 to cut hair extending through the foil. Further, each pre-trimmer 11 comprises a fixed cutting element 4 and a mobile cutting element 5, as per the prior art, and also comprises a fixed guard 13, positioned between the mobile cutting element 5 and the skin to limit contact between the mobile cutting teeth 7 and the skin.

The fixed cutting element 4 comprises a plurality of cutting teeth 6 that extend so that the distal ends 9 contact the skin. The distal ends 9 of the fixed cutting teeth 6 are rounded to prevent the fixed cutting teeth 6 damaging the skin and to reduce friction during use. The fixed cutting teeth 6 comprise a cutting portion to cooperate with the mobile cutting teeth 7 to cut any hairs that enter the space between the cutting teeth 6, 7.

The mobile cutting element 5 is driven by an actuator (not shown) to reciprocate in a parallel direction Y-Y' to create a cutting action in cooperation with the fixed cutting element 4. The mobile cutting teeth 7 do not extend as far as the fixed cutting teeth 6 in the direction of the skin.

The fixed guard 13 comprises a plurality of guard teeth 14 that extend from the supporting frame 12 and are equal in number and aligned with the fixed cutting teeth 6. The guard teeth 14 form a second contact point with the skin, the other being the fixed cutting teeth 6, and act to limit the deformation of the skin and so reduce the contact between the mobile cutting element 5 and the skin. The fixed guard 13 should be made from a hard and durable material, such as stainless steel or a water-resistant plastic.

The components of the pre-trimmers 11 are usually configured so that the mobile cutting element 5 of the first pre-trimmer is the same component as the mobile cutting element 5 of the second pre-trimmer, said components having two cutting faces on opposite sides. This allows a single actuator to be configured to simultaneously drive the mobile cutting element 5 of both pre-trimmers 11.

Figure 4:
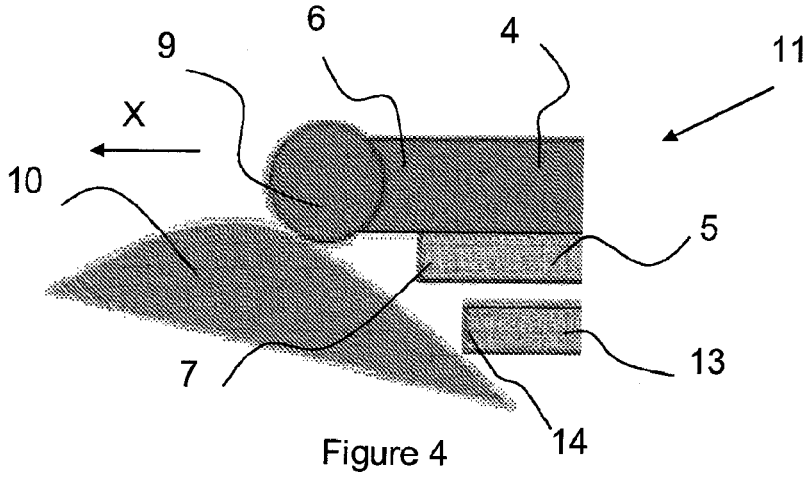
FIG. 4 shows a schematic side view of the embodiment of FIG. 3.

FIG. 4 shows a schematic side view of the fixed cutting element 4, mobile cutting element 5 and fixed guard 13. The three components extend in a direction perpendicular to the plane of the drawing and only one tooth 6, 7, 14 of each part is visible—the others being hidden behind those teeth that are visible. Also shown is the skin 10 that is being shaved by moving the shaver 1 in the direction X. The rounded distal ends 9 of the fixed cutting teeth 6 are in contact with the skin 10 and cause a doming effect as the shaver 1 is moved across the skin 10. The guard teeth 14 are also in contact with the skin 10 and act to counteract the doming effect and limit the contact between the mobile cutting element and the skin. The mobile cutting teeth 7 will cut any hairs that pass into the space between the cutting teeth by shearing the hair in cooperation with the fixed cutting teeth 6.

In this embodiment the fixed guard 13 is spaced apart from the mobile cutting element 5 so that no cutting action takes place between the fixed guard 13 and the mobile cutting element 5. The guard teeth 14 do not extend as far as the mobile cutting teeth 7 or the fixed cutting teeth so that the hairs may still be cut to a short length.

It will be apparent to a person skilled in the art that the length of the guard teeth 14 defines the cutting height of the pre-trimmer 11; if the guard teeth 14 are shorter, the mobile cutting teeth 7 will be closer to the skin 10 and achieve a closer cut, but may also cause more irritation; if the guard teeth 14 are longer, the mobile cutting teeth 7 will be further removed from the skin 10 and the cut will be less close but irritation will be reduced. Therefore, the length of the guard teeth 14 may be optimized so that adequate cutting of the hair is achieved without excessive contact between the mobile cutting teeth 7 and the skin 10. This optimal position may result in the guard teeth 14 being longer than the mobile cutting teeth 7, especially if, for example, the shaver 1 is being used to trim hair and not completely remove hair.

Figure 5:
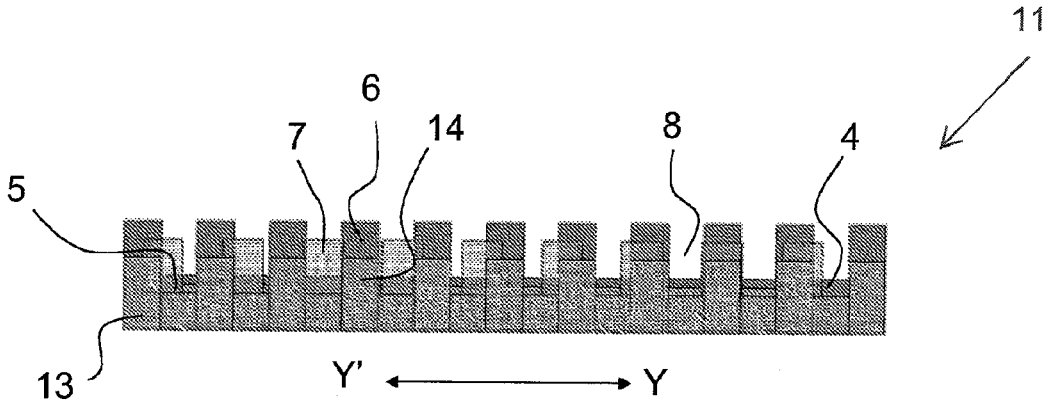
FIG. 5 shows a schematic end view, from the skin contacting side of the shaver, of the embodiment of FIG. 3.

FIG. 5 shows a schematic end view from the skin contacting side of the pre-trimmer 11 showing the fixed cutting element 4, mobile cutting element 5 and fixed guard 13. The fixed guard 13 is shown in the foreground with the mobile cutting element 5 immediately behind and the fixed cutting element 4 in the background. From this view the mobile cutting element 5 reciprocates in the direction Y-Y'. The quantity and shape of the teeth 6, 7, 14 shown are only schematic and do not represent the most desirable format for the pre-trimmer 11. In FIG. 5 there are an equal number of fixed cutting teeth 6 and guard teeth 14 and these teeth are aligned. If they are not aligned then hairs may be prevented from entering the regions 8 between the cutting teeth 6, 7 where the cutting takes place. In the embodiment shown in FIG. 5, the mobile cutting element 5 has fewer teeth 7 than the fixed cutting element 4 and fixed guard 13 and the mobile cutting teeth 7 are spaced differently, in this case further apart, to prevent an undesirable situation when all of the teeth 6, 7 are cutting at the same time which may jam and/or stall the pre-trimmer 11.

Figure 6:
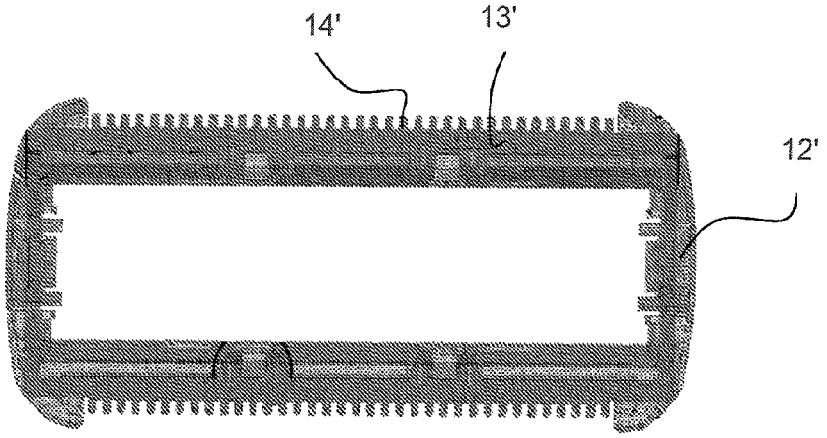
FIG. 6 shows an end view, from the skin contacting side of the shaver, of a second embodiment of the invention.

FIG. 6 shows a second embodiment of the invention whereby the fixed guard 13' is a separate component attached to support structure 12'. This component 13' may be made of stainless steel or, to achieve a more comfortable feel, plastic may be used. This adds greater versatility to the product and the fixed guard 13' may even be changeable, with varying length guard teeth 14' to give different cutting heights.

It will be appreciated that although the exemplary embodiments described herein refer to a hair shaver, the guard arrangement and trimmer may also be used on other types of hair trimmer, shaver or clipper.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

Other modifications and variations falling within the scope of the claims hereinafter will be evident to those skilled in the art.

The invention claimed is:

1. A hair trimming device comprising a mobile cutting element and a fixed cutting element positioned on one side of the mobile cutting element, the fixed and mobile cutting elements each comprising teeth configured so that hairs entering a space between said teeth are cut when the mobile cutting element is moving relative to the fixed cutting element, wherein a fixed guard is positioned on an opposite side of the mobile cutting element opposite the fixed cutting element to limit contact between the mobile cutting element and skin, wherein the fixed guard is positioned between the mobile cutting element and the skin to limit contact between the teeth of the mobile cutting element and the skin, wherein the fixed guard comprises teeth, wherein the teeth of the fixed cutting element form a first contact point with the skin, wherein the teeth of the fixed guard form a second contact point with the skin and are configured to limit deformation of the skin and to reduce the contact between the mobile cutting element and the skin, and wherein the teeth of the fixed cutting element extend further from a frame to the skin than the teeth of the fixed guard and the teeth of the mobile cutting element, such that the teeth of the fixed cutting element are configured to be closer to the skin at the first contact point than the teeth of the fixed guard and the teeth of the mobile cutting element.

2. The hair trimming device according to claim 1, wherein the teeth of the fixed guard overlap the teeth of the fixed cutting element.

3. The hair trimming device, according to claim 1, wherein the frame is configured to support the fixed guard.

4. The hair trimming device, according to claim 3, wherein the fixed guard is integrally formed with the frame.

5. The hair trimming device, according to claim 3, wherein the fixed guard is removably attachable to the frame.

6. The hair trimming device, according to claim 3, wherein the fixed guard is a separate component, attachable to the frame.

7. The hair trimming device, according to claim 1, wherein the teeth of the mobile cutting element extend further from the frame to the skin than the teeth of the fixed guard.

8. The hair trimming device, according to claim 1, wherein the fixed cutting element and the fixed guard comprise an equal number of teeth.

9. The hair trimming device, according to claim 1, wherein the teeth of the fixed cutting element and the teeth of the fixed guard are aligned.

10. The hair trimming device, according to claim 9, wherein the teeth of the mobile cutting element are spaced differently from the teeth of the fixed guard and the teeth of the fixed cutting element.

11. The hair trimming device of claim 1, wherein the first contact point and the second contact point contact the skin on either side of the mobile cutting element.

12. The hair trimming device of claim 1, wherein the teeth of the fixed guard are configured to allow the hairs to pass between the teeth of the fixed guard.

13. The hair trimming device of claim 1, wherein the teeth of the fixed and mobile cutting elements are configured to cooperate with each other to create a cutting action, the cutting action being configured to cut hairs that enter the space between the teeth of the fixed and mobile cutting elements, and wherein the fixed guard is configured to be spaced apart from the mobile cutting element to prevent the cutting action between the fixed guard and the mobile cutting element.

14. The hair trimming device of claim 1, wherein distal ends of the teeth of the fixed cutting element are rounded, the distal ends being in contact with the skin at the first contact point, and wherein the teeth of the fixed guard are in contact with the skin at the second contact point.

15. The hair trimming device of claim 1, wherein a length of the teeth of the fixed guard defines a cutting height of the hair trimming device.

16. The hair trimming device of claim 1, wherein the teeth of the mobile cutting element are spaced differently from the teeth of the fixed guard and the teeth of the fixed cutting element such that the teeth of the mobile cutting element are spaced further apart than the teeth of the fixed guard and the teeth of the fixed cutting element, and wherein the mobile cutting element has fewer teeth than the fixed guard and the fixed cutting element.

17. The hair trimming device of 1, wherein the frame is configured to being attached to one of a plurality of different fixed guards, each of the different fixed guards having teeth with varying length to provide different cutting heights.

18. The hair trimming device of claim 1, wherein the teeth of the fixed cutting element, the teeth of the mobile cutting element and the teeth of the fixed guard each has a different length extending a different distance from the frame towards the skin, and wherein the teeth of the fixed cutting element has a longer length extending a longer distance from the frame towards the skin than the teeth of the mobile cutting element and the teeth of the fixed guard.

19. A shaver comprising:

a foil;

a cutting blade associated with the foil to cut hair extending through the foil; and a hair trimming device comprising a mobile cutting element and a fixed cutting element positioned on one side of the mobile cutting element, the fixed and mobile cutting elements each comprising teeth configured so that hairs entering a space between said teeth are cut when the mobile cutting element is moving relative to the fixed cutting element, wherein a fixed guard is positioned on an opposite side of the mobile cutting element opposite the fixed cutting element to limit contact between the mobile cutting element and skin, wherein the fixed guard is positioned between the mobile cutting element and the skin to limit contact between the teeth of the mobile cutting element and the skin, wherein the fixed guard comprises teeth, wherein the teeth of the fixed cutting element form a first contact point with the skin, wherein the teeth of the fixed guard form a second contact point with the skin and are configured to limit deformation of the skin and to reduce the contact between the mobile cutting element and the skin, wherein the teeth of the fixed cutting element extend further from a frame to the skin than the teeth of the fixed guard and the teeth of the mobile cutting element, such that the teeth of the fixed cutting element are configured to be closer to the skin at the first contact point than the teeth of the fixed guard and the teeth of the mobile cutting element, and wherein the hair trimming device is positioned adjacent to said foil.

20. The shaver according to claim 19, comprising a further hair trimming device, wherein the hair trimming device and the further hair trimming device are positioned adjacent to opposite sides of the foil.

* * * * *